US006881913B1

(12) United States Patent
Mathewes

(10) Patent No.: US 6,881,913 B1
(45) Date of Patent: Apr. 19, 2005

(54) PRESSURE OPERATED SAFETY SWITCH

(75) Inventor: Christopher W. Mathewes, Greenville, SC (US)

(73) Assignee: DSS Operating Valve Company, Troy, MI (US)

( * ) Notice: Subject to any disclaimer, the term of this patent is extended or adjusted under 35 U.S.C. 154(b) by 0 days.

(21) Appl. No.: 10/780,074

(22) Filed: Feb. 17, 2004

(51) Int. Cl.[7] ..... H01H 35/34
(52) U.S. Cl. ..... 200/82 R; 200/82 A; 200/81.4
(58) Field of Search ..... 200/81 R, 81.4, 200/81.5, 82 R, 82 B, 82 A, 61.22, 61.25, 61.26

(56) References Cited

U.S. PATENT DOCUMENTS 3,815,057 A * 6/1974 Stahle ..... 335/1
4,072,126 A 2/1978 Kemp
4,681,992 A * 7/1987 Kazmierski ..... 200/82 E
4,855,545 A * 8/1989 Kreuter ..... 200/81.4
5,034,577 A * 7/1991 Gesche et al. ..... 200/82 R
5,122,628 A * 6/1992 McLelland et al. ..... 200/83 Y
5,136,278 A * 8/1992 Watson et al. ..... 340/592
5,300,741 A 4/1994 Hogue et al.
5,799,561 A 9/1998 Wetzel et al.
6,291,791 B1 * 9/2001 Fujita et al. ..... 219/69.13
6,676,107 B1 * 1/2004 Sticht ..... 251/129.17
2003/0009314 A1 1/2003 Summers et al.

* cited by examiner

*Primary Examiner*—Michael A. Friedhofer
(74) *Attorney, Agent, or Firm*—MacMillan, Sobanski & Todd, LLC

(57) ABSTRACT

A pressure-operated safety switch is applied to a point in the compressed air system, which requires monitoring for presence of pressurized air. Pressurized air is introduced into the switch through a tube or other suitable fitting at the point needing monitoring. The pressurized air is split internally to force redundant, independent pistons to an extended position. Under safe conditions (i.e., the absence of pressurized air), electrical contacts on each piston makes physical contact with switch body contacts to create two independent electrical switch paths. Pressure required to force the pistons away from the electrical contacts is adjustable by using a spring and set screw, for example.

20 Claims, 6 Drawing Sheets

PRESSURE OPERATED SAFETY SWITCH

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to pressure sensors, and, more specifically, to a redundant safety switch for detecting the presence of pressurized fluid.

Compressed air systems are used in many industrial settings to operate various types of pneumatic actuators. Air is compressed by a compressor and delivered to the actuators via a distribution system including conduits and valves. Some systems may cover a very large area with one or more high capacity compressors pumping compressed air or other fluid into an extensive network of delivery conduits. The network may include sections that can be isolated from the compressor(s) by closing certain valves. This allows portions of the system to be disassembled for maintenance or other reasons.

Prior to attempting to disassemble or service a pneumatic system, it is necessary to ensure that the supply of pressurized fluid is removed from the point in the system being accessed. Various safety standards and governmental requirements exist, such as European Standard EN954, which direct that a pressure monitoring device be used to avoid unsafe servicing operations.

In certain applications, it may be necessary or desirable to perform redundant monitoring so that the failure of one monitoring device does not lead to attempted servicing at a point still receiving line pressure. A pressure switch is one typical type of monitoring device. Deploying redundant sensors has typically required the mounting of two separate pressure switches, more than doubling the cost of obtaining the safety function.

SUMMARY OF THE INVENTION

The present invention has the advantage of providing a low cost, compact, highly reliable redundant pressure switch that allows a user to verify that a safe condition exists before accessing a pneumatic system.

In one aspect of the invention, a pressure switch is provided for monitoring the presence of a pressurized fluid at a predetermined pressure in a pneumatic system. The switch includes a switch body and a first pair of contacts disposed at a first end of the switch body. A first stem extends from the switch body at the first end and has a first internal passage for coupling to a source of the predetermined pressure. A first piston is slidably received on the first stem and has a first electrically conductive surface at a first piston end for selectably contacting the first pair of contacts. A second pair of contacts is disposed at a second end of the switch body. A second stem extends from the switch body at the second end and has a second internal passage for coupling to the source of the predetermined pressure. A second piston is slidably received on the second stem and has a second electrically conductive surface at a first piston end for selectably contacting the second pair of contacts. A housing receives the switch body and the first and second pistons. A first spring is retained between a second piston end of the first piston and the housing. A second spring is retained between a second piston end of the second piston and the housing. When the predetermined pressure is present then pressurized fluid within the first and second internal passages extends the first and second pistons along the first and second stems, respectively, to open the first and second pairs of contacts.

DETAILED DESCRIPTION OF PREFERRED EMBODIMENTS

The pressure-operated safety switch of the present invention is applied to a point in the compressed air system, which requires monitoring for presence of pressurized air. Pressurized air is introduced into the switch through a tube or other suitable fitting at the point needing monitoring. The pressurized air is split internally to force redundant, independent pistons to an extended position. Under safe conditions (i.e., the absence of pressurized air), electrical contacts on each piston makes physical contact with switch body contacts to create two independent electrical switch paths. Pressure required to force the pistons away from the electrical contacts is adjustable by using a spring and set screw, for example.

A further advantage of the present invention is that all failure modes of the pressure switch are fail-to-safe. In a properly operating switch, the two piston contacts are physically removed from their two respective body contacts, thereby creating an electrical open circuit in the presence of pressurized air. Any open electrical switch path indicates that a potentially non-safe condition exists for service personnel. Thus, if one piston fails to operate properly, the two switch paths will indicate dissimilar results and a switch failure is apparent. The likelihood of both pistons failing to operate at the same time is probabilistically insignificant.

The pressure-operated switch device of the present invention is fully enclosed and sealed so that it is capable of being used in harsh, dirty, washdown environments.

Figure 1:
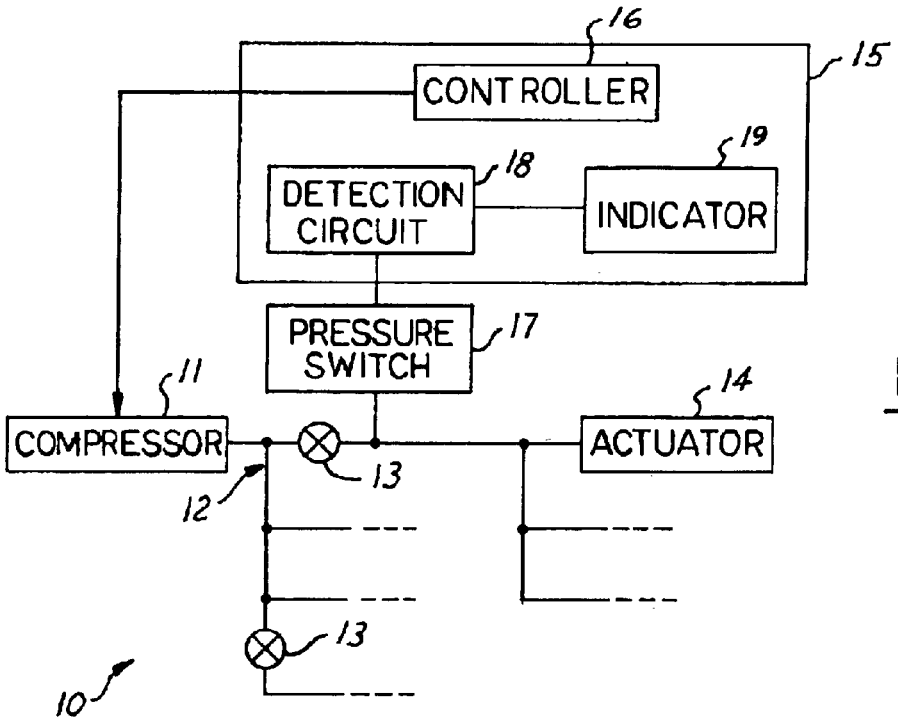
FIG. 1 is a block diagram showing a pneumatic system employing the pressure switch of the present invention.

Referring to FIG. 1, a pneumatic (e.g., compressed air) system 10 includes a compressor 11 coupled to a fluid distribution system 12. Distribution system 12 may include a plurality of compressed air conduits interconnected by valves 13 to various sub-circuits, each of which preferably includes various pneumatic actuators such as an actuator 14. Pneumatic system 10 may be part of a manufacturing system and actuator 14 may include a pneumatic press, for example.

Compressor 11 may operate under control of a system control panel 15 including a controller 16 for providing an on/off signal to compressor 11. A pressure switch 17 is connected to the sub-circuit of distribution system 12 including actuator 14 for sensing the presence of pressurized air and provides an output signal to a detection circuit 18 in system control panel 15. Detection circuit 18 drives an indicator 19 for allowing a system operator to determine whether maintenance operations can be safely conducted on the sub-circuit.

Figure 2:
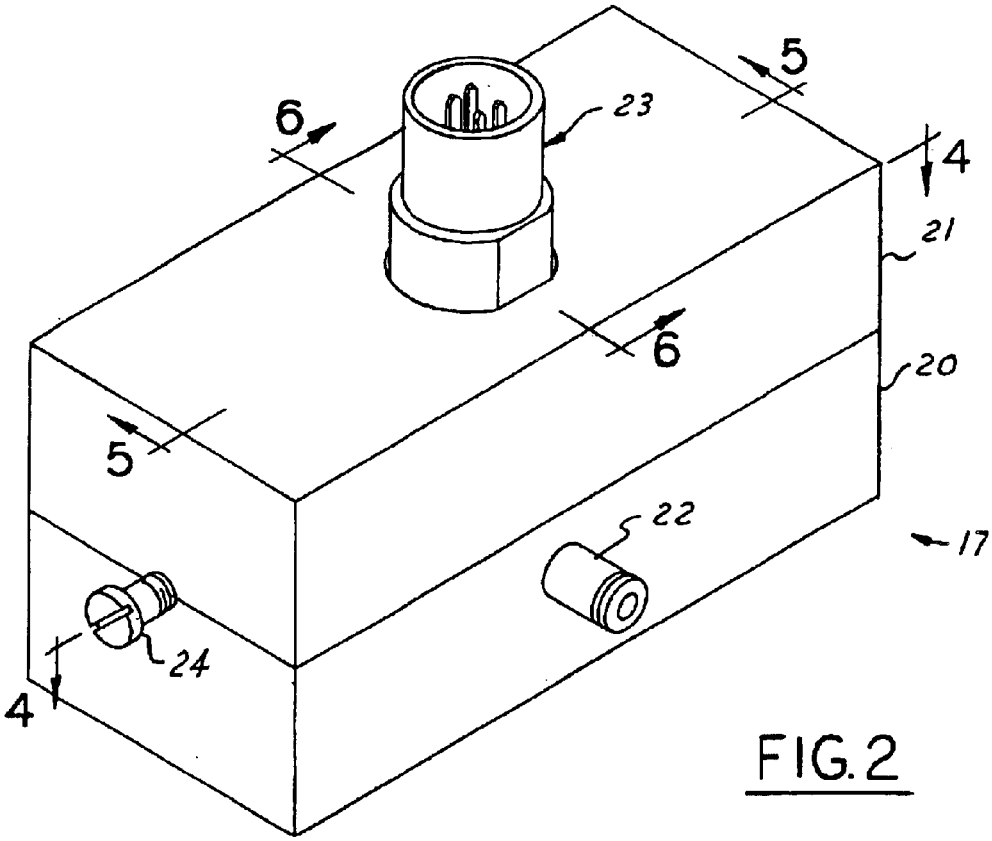
FIG. 2 is a perspective view of the pressure switch.

The pressure switch 17 is shown in FIG. 2. A lower housing 20 is mated with an upper housing 21. A fluid inlet port 22 passes through lower housing 20. An electrical connector 23 provides for an electrical connection of the switch paths within pressure switch 17. A set screw 24 passes through housings 20 and 21 to control a pressure sensing threshold as described below. Housings 20 and 21 are hermetically sealed.

Figure 3:
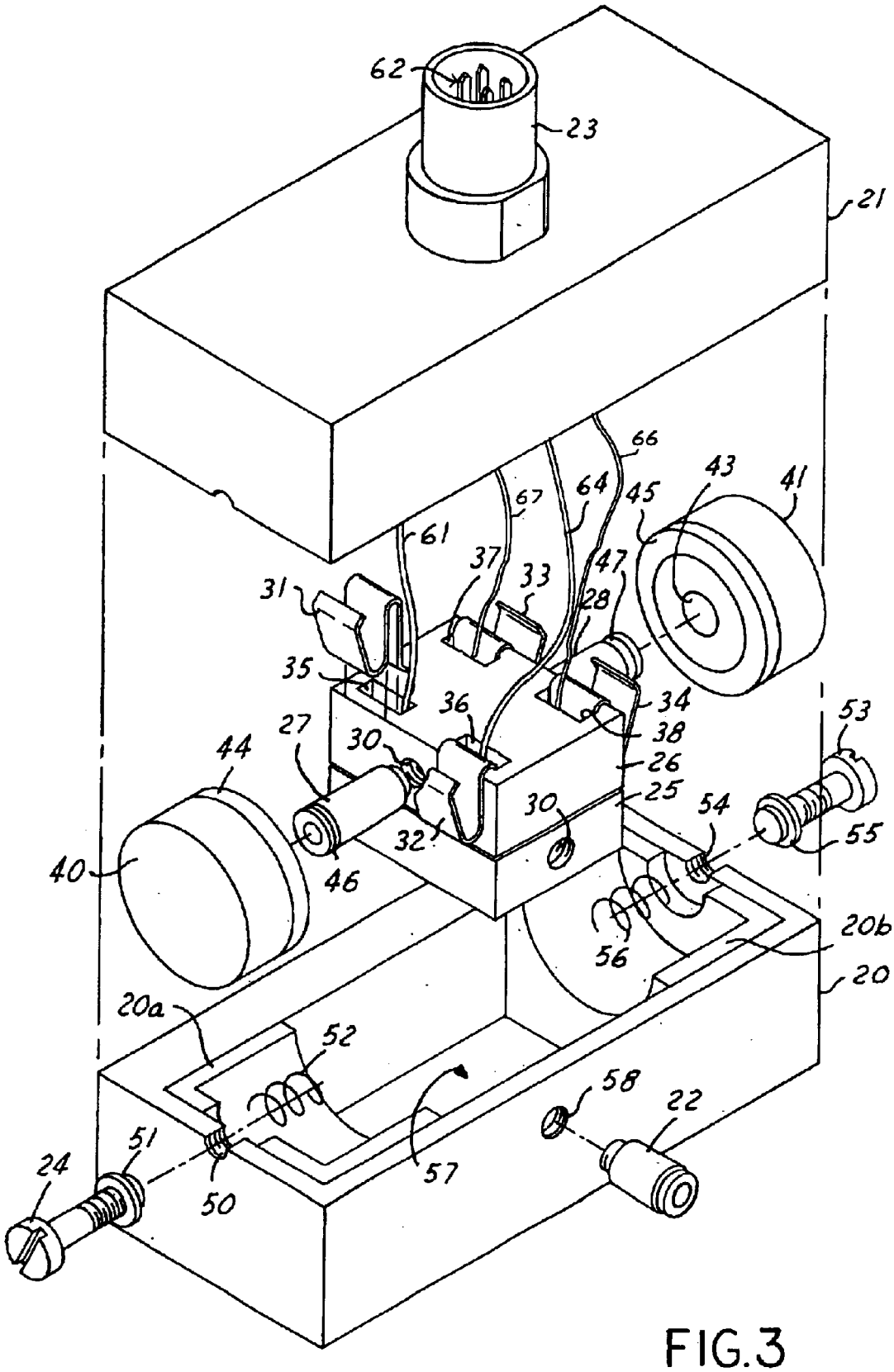
FIG. 3 is an exploded perspective view of the switch of FIG. 2.

FIG. 3 shows an exploded view revealing an internal switch body including a lower switch body 25 and an upper switch body 26. A pair of cylindrical stems 27 and 28 extend from opposite sides of upper switch body 26. Lower switch body 25 includes a fluid passage 30 in communication with internal passages in stems 27 and 28 and with fluid inlet port 22.

A first pair of electrical contacts 31 and 32 are disposed on opposite sides of stem 27. A second pair of contacts 33 and 34 are disposed on opposite sides of stem 28. Contacts 31–34 are in the form of metallic clips that clip into slots 35–38, respectively.

Switch 17 further includes first and second pistons 40 and 41 including central bores 42 and 43 slidably received on stems 27 and 28, respectively. Pistons 40 and 41 may be comprised of molded plastic and respectively include conductive discs 44 and 45 positioned for contacting contacts 31–34 in each of the redundant switches. Thus, one switch path includes disc 44 and contacts 31 and 32 while the other switch path includes disc 45 and contacts 33 and 34. Stems 27 and 28 include o-rings 46 and 47 sized to seal against bores 42 and 43, respectively, so that pressure introduced into passage 30 via fluid inlet port 22 acts upon pistons 40 and 41 to extends the pistons away from the switch body to thereby open the pairs of contacts in the presence of pressurized fluid.

Pistons 40 and 41 are normally urged against their respective contacts by springs 52 and 56 as follows. Upper and lower housings 21 include a threaded hole 50 for receiving set screw 24. A push plate 51 engages the internal end of set screw 24 inside the housing and is free to move longitudinally within the housing. Spring 52 is retained between push plate 51 and piston 40. Thus, the force which must be overcome by pressured fluid to extend piston 40 is adjustable by controlling the preloading of spring 52 according to the position of set screw 24 and push plate 51. Likewise, a set screw 53 passes through a threaded hole 54 and has a push plate 55 retained inside the housing. A spring 56 is preloaded between push plate 55 and the end of piston 41. Housing halves 20 and 21 create an internal cavity 57 which receives the switch body and pistons. Lower housing 20 may include a pair of inserts 20*a* and 20*b* for guiding the longitudinal motion of pistons 40 and 41. Alternatively, the guiding cylinders may be integrally formed in housings 20 and 21. Lower housing 20 further includes an aperture 58 receiving fluid inlet port 22 and aligned with passage 30 in lower switch body 25.

FIG. 3 shows a pair of leads 61 and 64 connected to contacts 31 and 32, respectively. The other ends of leads 61 and 64 are connected to respective ones of the connector pins 62 which may be accessed as part of a first sensor switch. A pair of leads 66 and 67 are connected to contacts 33 and 34, respectively. The other ends of leads 66 and 67 are connected to other respective ones of the connector pins 62 and may be accessed as part of a second (i.e., redundant) sensor switch. Wires 61, 64, 66, and 67 may be connected by soldering, for example. The output pins 62 are connected to a detection circuit in a known manner. In the event that housings 20 and 21 are conductive (e.g., metallic), a fifth connector pin (not shown) connected by a wire (not shown) to the housing is preferably included for connecting the housing to a ground wire.

Figure 4:
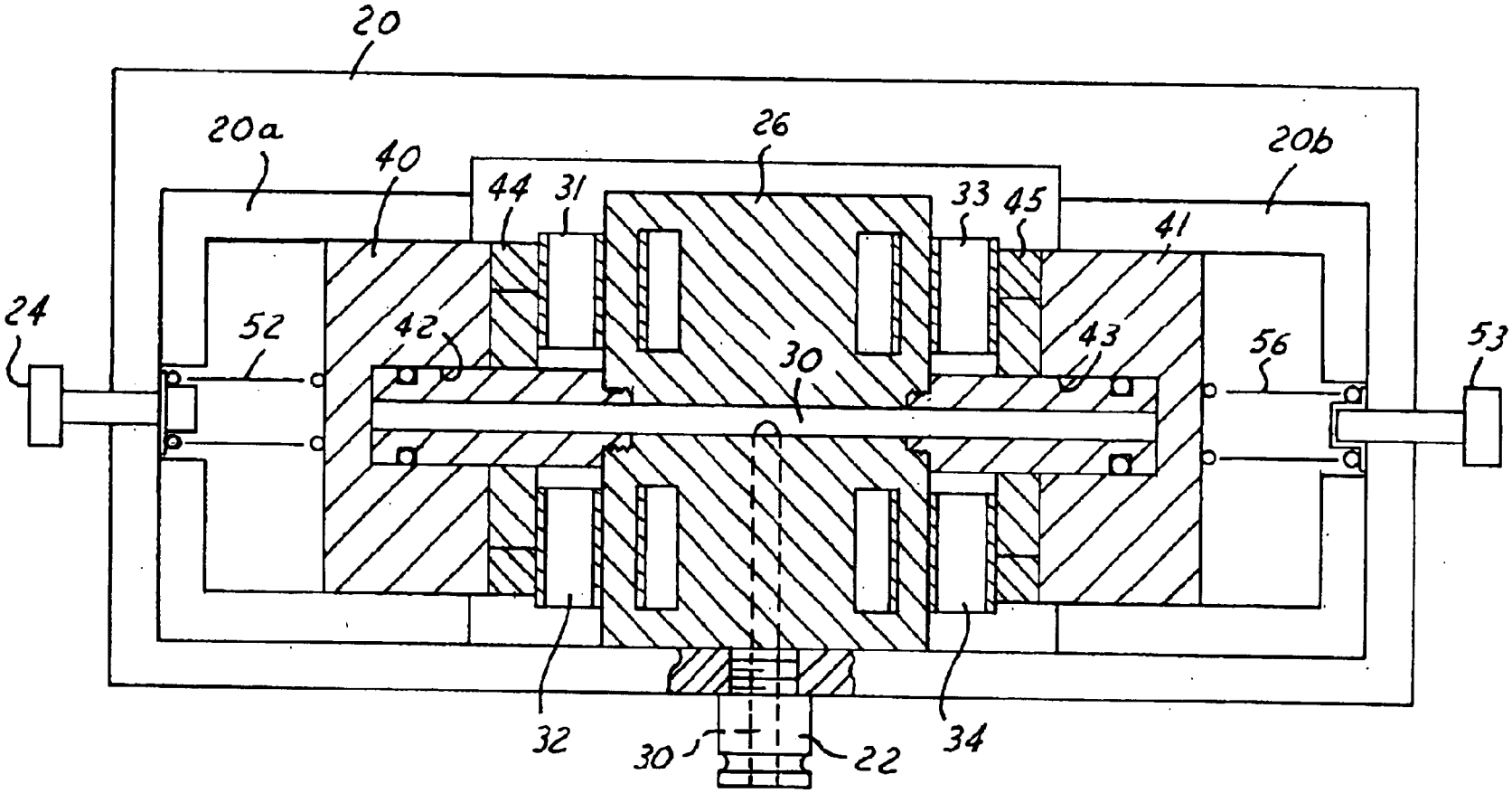
FIG. 4 is a cross-sectional view along lines 4—4 of FIG. 2.

FIG. 4 shows a horizontal cross section of switch 17 in its rest state without sufficient pressurized fluid being introduced into passage 30 to extend pistons 40 and 41. Consequently, conductive disc 44 creates a signal path between contacts 31 and 32 while conductive disc 45 creates a signal path between contacts 33 and 34. A preloaded spring force from springs 52 and 56 maintains good electrical contact between the conductive discs and the contacts. When sufficient fluid pressure is present in passage 30, it acts against pistons 40 and 41 to extend them away from switch body 26 thereby compressing springs 52 and 56 and disconnecting conductive discs 44 and 45 from the switch contacts.

Figure 5:
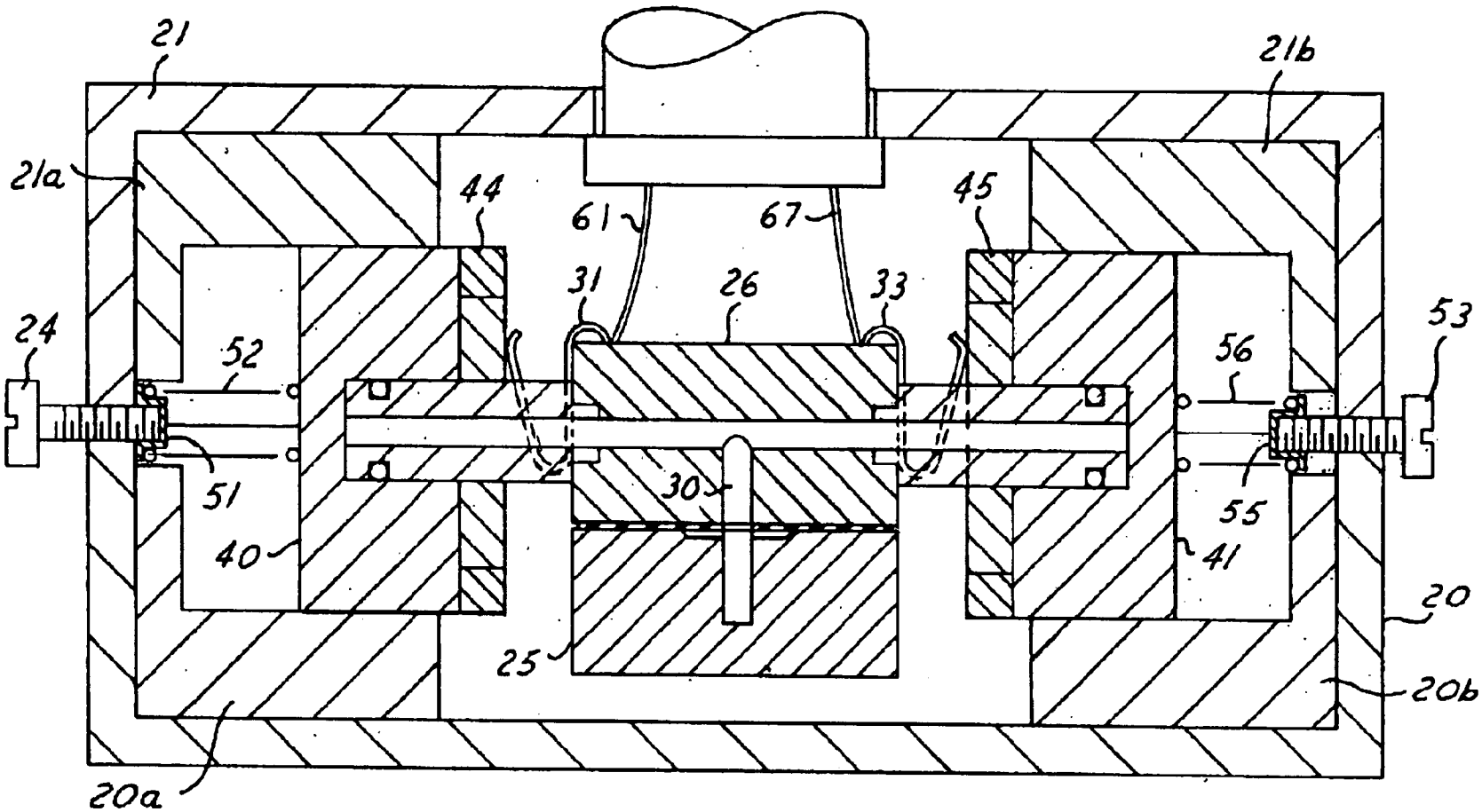
FIG. 5 is a cross-sectional view along lines 5—5 of FIG. 2.

FIG. 5 shows a vertical cross-section wherein set screw 53 has been rotated in order to extend push plate 55 into the housing interior providing a higher spring pre-load force for spring 56. Thus, a pressure threshold can be controlled at which the pressure switch responds.

Figure 6:
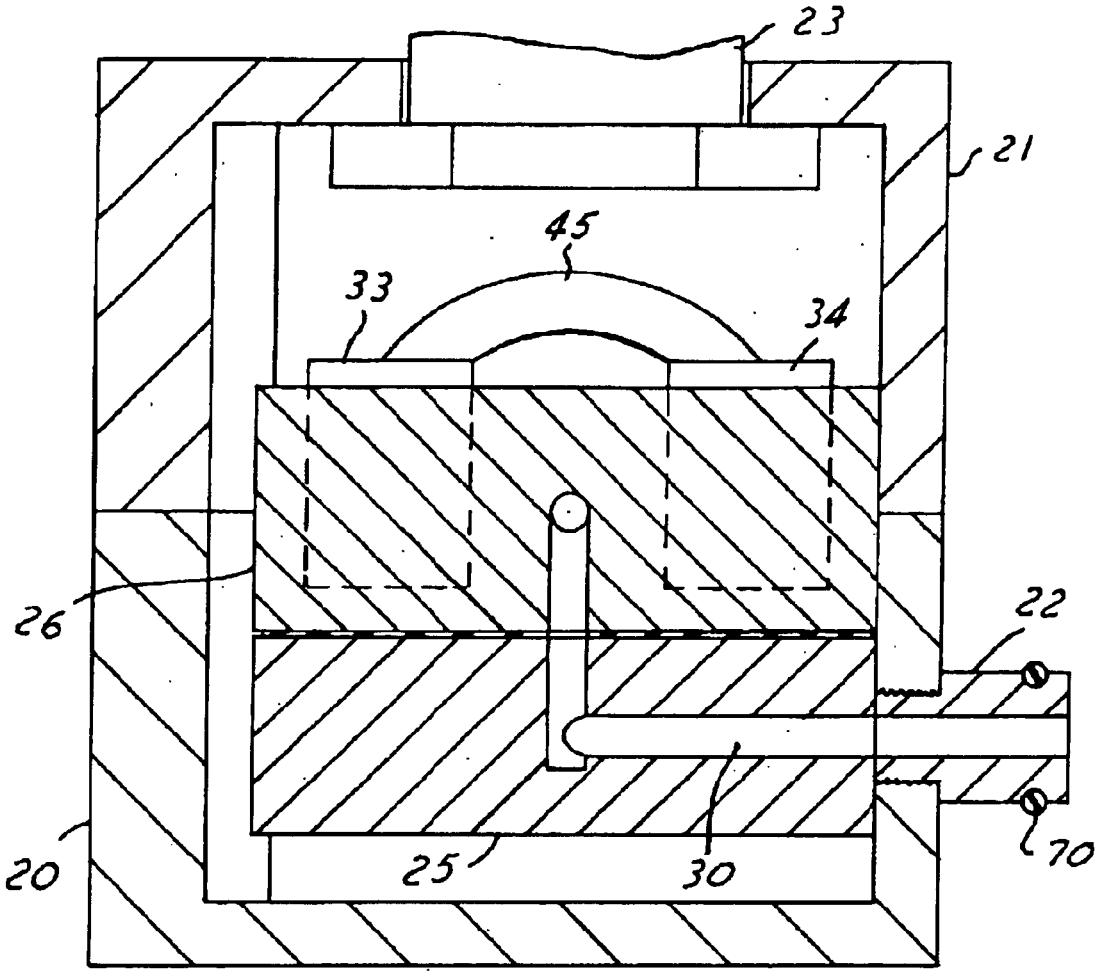
FIG. 6 is a cross-sectional view along lines 6—6 of FIG. 2.

FIG. 6 is a horizontal cross section showing the portion of fluid path passage 30 from fluid inlet port 22 through lower switch body 25 and upper switch body 26. Fluid inlet port 22 further includes an o-ring 70 for sealing with a tube or conduit for connecting pressure switch 17 to a desired point in the compressed air distribution system.

Figure 7:
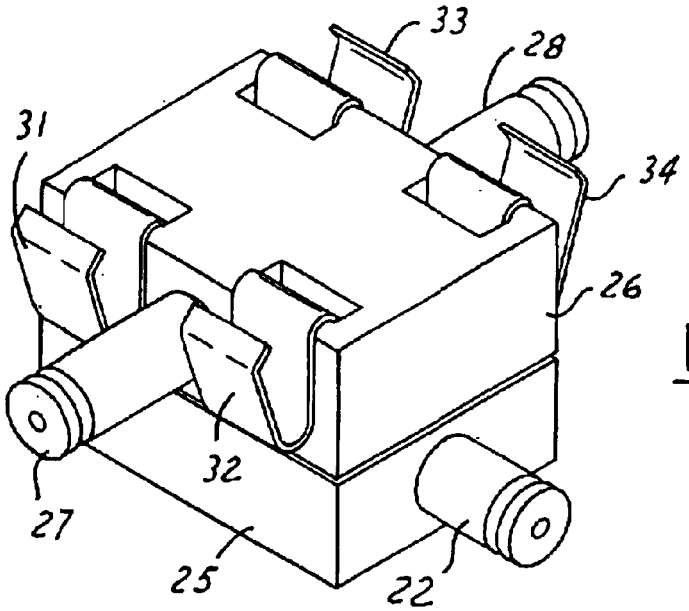
FIG. 7 is a perspective view of the switch body of the pressure switch.
Figure 8:
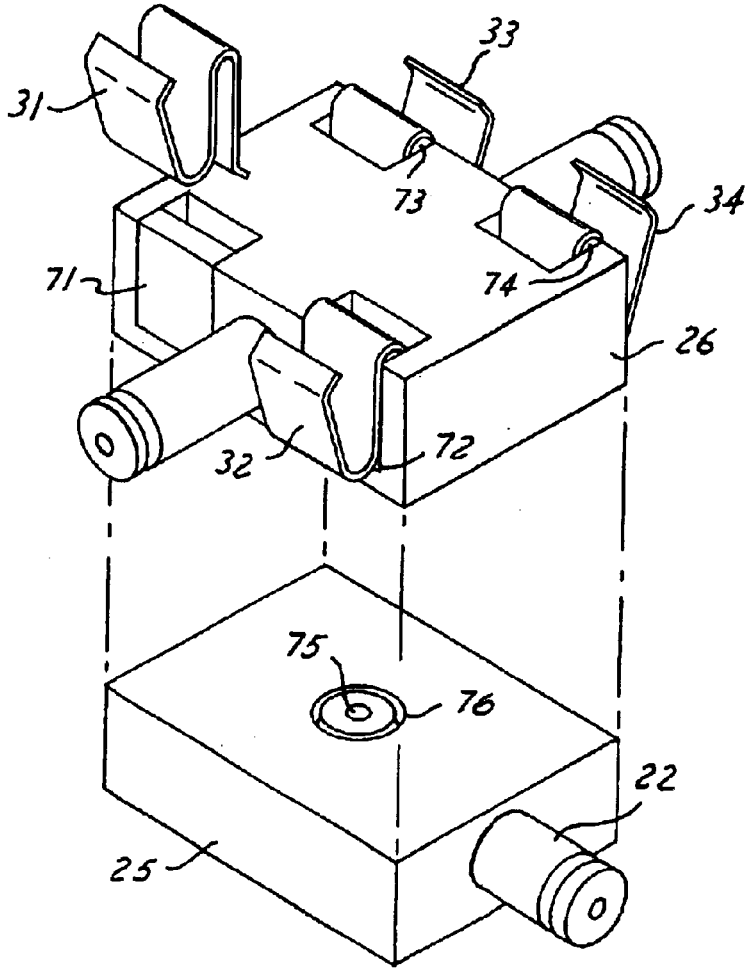
FIG. 8 is an exploded perspective view of the switch body with added insulators.

FIGS. 7 and 8 show the switch body assemblies in perspective views. Switch body halves 25 and 26 may preferably be comprised of a molded plastic, for example. Alternatively, they may be formed of a machined metallic block requiring the use of insulators 71–74 for lining slots 35–38 as shown in FIG. 8 in order to insulate contacts 31–34 from upper switch body 26. Plastic or paper liners may be used for insulators 71–74. Lower switch body 25 includes an aperture 75 as part of fluid passage 30 and a recess 76 for retaining an o-ring to provide sealing of fluid passage 30.

What is claimed is:

1. A pressure switch for monitoring the presence of a pressurized fluid at a predetermined pressure in a pneumatic system, comprising:

a switch body;

a first pair of contacts disposed at a first end of said switch body;

a first stem extending from said switch body at said first end and having a first internal passage for coupling to a source of said predetermined pressure;

a first piston slidably received on said first stem and having a first electrically conductive surface at a first piston end for selectably contacting said first pair of contacts;

a second pair of contacts disposed at a second end of said switch body;

a second stem extending from said switch body at said second end and having a second internal passage for coupling to said source of said predetermined pressure;

a second piston slidably received on said second stem and having a second electrically conductive surface at a first piston end for selectably contacting said second pair of contacts;

a housing for receiving said switch body and said first and second pistons;

a first spring retained between a second piston end of said first piston and said housing; and a second spring retained between a second piston end of said second piston and said housing;

whereby when said predetermined pressure is present then pressurized fluid within said first and second internal passages extends said first and second pistons along said first and second stems, respectively, to open said first and second pairs of contacts.

2. The pressure switch of claim 1 wherein said switch body is comprised of an insulating material and wherein said first and second pairs of contacts are each comprised of a respective pair of metallic clips mounted to said switch body.

3. The pressure switch of claim 2 further comprising external terminals and further comprising output conductors connected between said metallic clips and said external terminals.

4. The pressure switch of claim 1 wherein said switch body is comprised of a conducting material, wherein said pressure switch further comprises a plurality of insulators, and wherein said first and second pairs of contacts are each comprised of a respective pair of metallic clips mounted to a respective insulator on said switch body.

5. The pressure switch of claim 4 further comprising external terminals and further comprising output conductors connected between said metallic clips and said external terminals.

6. The pressure switch of claim 1 further comprising:

a first spring adjuster coupled to said first spring for adjusting said predetermined pressure; and a second spring adjuster coupled to said second spring for adjusting said predetermined pressure.

7. The pressure switch of claim 6 wherein said first and second spring adjusters each comprises:

a respective adjustment plate between said respective springs and said housing; and a respective set screw bearing against a respective adjustment plate for adjusting a force applied by a respective spring against a respective piston.

8. The pressure switch of claim 1 further comprising:

a first o-ring mounted to said first stem for receiving said first piston; and a second o-ring mounted to said second stem for receiving said second piston.

9. The pressure switch of claim 1 further comprising a fluid port coupled to said switch body, and wherein said switch body includes an internal passage coupling said fluid port with said first and second internal passages of said first and second stems, respectively.

10. The pressure switch of claim 1 wherein said housing is hermetically sealed.

11. A pneumatic system comprising:

a compressor for supplying pressurized fluid;

a distribution system for receiving said pressurized fluid;

a pressure switch coupled to said distribution system providing a pair of redundant signals each indicating the presence of a pressurized fluid at a predetermined pressure; and a system monitor for indicating an absence of said predetermined pressure when both of said redundant signals correspond to such absence;

wherein said pressure switch comprises:

a switch body;

a first pair of contacts disposed at a first end of said switch body;

a first stem extending from said switch body at said first end and having a first internal passage for coupling to a source of said predetermined pressure;

a first piston slidably received on said first stem and having a first electrically conductive surface at a first piston end for selectably contacting said first pair of contacts;

a second pair of contacts disposed at a second end of said switch body;

a second stem extending from said switch body at said second end and having a second internal passage for coupling to said source of said predetermined pressure;

a second piston slidably received on said second stem and having a second electrically conductive surface at a first piston end for selectably contacting said second pair of contacts;

a housing for receiving said switch body and said first and second pistons;

a first spring retained between a second piston end of said first piston and said housing; and a second spring retained between a second piston end of said second piston and said housing;

whereby when said predetermined pressure is present then pressurized fluid within said first and second internal passages extends said first and second pistons along said first and second stems, respectively, to open said first and second pairs of contacts.

12. The pneumatic system of claim 11 wherein said switch body is comprised of an insulating material and wherein said first and second pairs of contacts are each comprised of a respective pair of metallic clips mounted to said switch body.

13. The pneumatic system of claim 12 further comprising external terminals and further comprising output conductors connected between said metallic clips and said external terminals.

14. The pneumatic system of claim 11 wherein said switch body is comprised of a conducting material, wherein said pressure switch further comprises a plurality of insulators, and wherein said first and second pairs of contacts are each comprised of a respective pair of metallic clips mounted to a respective insulator on said switch body.

15. The pneumatic system of claim 14 further comprising external terminals and further comprising output conductors connected between said metallic clips and said external terminals.

16. The pneumatic system of claim 11 further comprising:

a first spring adjuster coupled to said first spring for adjusting said predetermined pressure; and a second spring adjuster coupled to said second spring for adjusting said predetermined pressure.

17. The pneumatic system of claim 16 wherein said first and second spring adjusters each comprises:

a respective adjustment plate between said respective springs and said housing; and a respective set screw bearing against a respective adjustment plate for adjusting a force applied by a respective spring against a respective piston.

18. The pneumatic system of claim 1 further comprising:

a first o-ring mounted to said first stem for receiving said first piston; and a second o-ring mounted to said second stem for receiving said second piston.

19. The pneumatic system of claim 11 further comprising a fluid port coupled to said switch body, and wherein said switch body includes an internal passage coupling said fluid port with said first and second internal passages of said first and second stems, respectively.

20. The pneumatic system of claim 11 wherein said housing is hermetically sealed.

* * * * *